US006690897B2

(12) United States Patent
Takami

(10) Patent No.: US 6,690,897 B2
(45) Date of Patent: Feb. 10, 2004

(54) CHARGING DEVICE HAVING ROTATABLE CHARGING ROLLER AND DC VOLTAGE APPLYING MEANS OR SOURCE

(75) Inventor: Norio Takami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,407

(22) Filed: Jan. 30, 2002

(65) Prior Publication Data

US 2002/0159793 A1 Oct. 31, 2002

(30) Foreign Application Priority Data

Jan. 31, 2001 (JP) ..... 2001-024324

(51) Int. Cl.[7] ..... G03G 15/02
(52) U.S. Cl. ..... 399/50; 361/235; 399/176
(58) Field of Search ..... 399/50, 174, 176; 361/225, 230, 235

(56) References Cited

U.S. PATENT DOCUMENTS 4,371,252 A * 2/1983 Uchida et al. ..... 399/176 X
4,380,384 A * 4/1983 Ueno et al. ..... 399/176
4,727,453 A * 2/1988 Ewing ..... 399/176 X
5,412,455 A * 5/1995 Ono et al. ..... 399/176
5,416,565 A * 5/1995 Noda ..... 399/176
5,475,472 A * 12/1995 Saito et al. ..... 399/176 X
5,592,263 A * 1/1997 Adachi et al. ..... 399/176

FOREIGN PATENT DOCUMENTS

JP 58-111055 * 7/1983
JP 5-100551 * 4/1993
JP 9-096951 * 4/1997

* cited by examiner

*Primary Examiner*—Fred L Braun
(74) *Attorney, Agent, or Firm*—Fitzpatrick, Cella, Harper & Scinto

(57) ABSTRACT

A charging device includes a rotatable elastic charging roller, contactable to a member to be charged, for electrically charging the member to be charged. The charging device also includes a DC voltage source for applying a DC voltage to the charging roller. The voltage source is capable of controlling the width of a variation of the DC voltage, the variation being caused by passage of a deformed portion of the charging roller, resulting from contact between the member to be charged and the charging roller, by a charging region of the charging roller for the member to be charged, to be not more than 1%.

13 Claims, 4 Drawing Sheets

CHARGING DEVICE HAVING ROTATABLE CHARGING ROLLER AND DC VOLTAGE APPLYING MEANS OR SOURCE

FIELD OF THE INVENTION AND RELATED ART

The present invention relates to a charging device suitably usable with an image forming apparatus such as a copying machine or a printer, more particularly to a charging device having a charging member contactable to a member to be charged. Conventionally, the use has been made with a non-contact type corona charger as charging means for electrically charging an electrostatic latent image bearing member (image bearing member) such as an electrophotographic photosensitive member, a dielectric member for electrostatic recording or the like in an image forming apparatus of an electrophotographic type, electrostatic recording type or the like.

Recently, a contact charging device in which a charging member supplied with a voltage is contacted to the member to be charged to electrically charge the member to be charged, is used because of the advantages in the low amount of the ozone production, low electric power and so on. Particularly, a roller charging type apparatus using an electroconductive elastic roller charging roller) as the contact charging member, is used because of the advantages in the stabilization of the charging. In such a system, a charging roller is press-contacted to the member to be charged and is rotated while being supplied with a voltage, by which the member to be charged is electrically charged.

Referring first to FIG. 6, there is shown a schematic structure of a charging device of such a roller charging type (a). In this Figure, designated by a reference numeral 3 is a member to be charged, 4 is a charging roller (contact charging member) contacted to the member to be charged 3.

The member to be charged 3 is, for example, an electrophotographic photosensitive member in the form of a rotatable drum as an electrostatic latent image bearing member used in an electrophotographic image forming apparatus, and it is rotated in the clockwise direction as indicated by an arrow at a predetermined peripheral speed.

The charging roller 4 fundamentally comprises an electroconductive core metal 40, an electroconductive elastic layer 41 thereon, which is integral and concentric with the core metal. The charging roller 4 is rotatably supported by bearings to the opposite ends of the core metal, and is urged to the photosensitive member with a predetermined urging force by urging means. Thus, a nip N is formed between the photosensitive member 3 and the elastic layer 41, and the charging roller 4 is rotated by the rotation of the photosensitive member 3.

The charging roller 4 is supplied with a predetermined charging bias from a voltage source S, so that outer surface of the rotating photosensitive drum 3 is electrically charged to a predetermined surface potential.

The electrical charging of the photosensitive member 3 by the charging roller 4 occurs mainly due to the electric discharge from the charging roller 4 to the photosensitive member 3 in small discharge regions a which are fine gaps between the charging roller 4 photosensitive member 3 at lateral and portions of the press-contact nip N. Therefore, the electric charging begins when the voltage applied to the charging roller 4 exceeds a threshold voltage.

For example, when the charging is to be effected to an electrophotographic OPC photosensitive member 3 having a thickness of 15 $\mu$m, the charging roller 4 is supplied with a voltage of approx. −560 V, by which the surface potential of the photosensitive member 3 rises, and thereafter, the surface potential of the photosensitive member linearly rises proportionally to the applied voltage (the inclination of rising relative to the applied voltage is 1). The threshold voltage is defined as a charging starting voltage Vth.

Therefore, in order to provide a surface potential of the photosensitive member VD required for an electrophotographic process, the charging roller 4 is to be supplied with a DC voltage of Vth+VD. Here, the contact charging type in which the member to be charged is electrically charged by application of DC voltage alone to the contact charging member, is called "DC charging type".

Since the electrical charging of the photosensitive member 3 by the charging roller 4 occurs mainly due to the electric discharge from the charging roller 4 to the photosensitive member 3 in small discharge regions a which are fine gaps between the charging roller 4 photosensitive member 3 at lateral and portions of the press-contact nip, as described hereinbefore, it is desirable that gaps are uniform in order to accomplish uniform charging. In this sense, the surface of the charging member is smooth.

However, when the charging roller 4 is kept press-contacted to the photosensitive member 3 for a long term, for example, when a process cartridge including a charging roller is left unused for a long term, the charging roller 4 may be deformed permanently at the position where the photosensitive member 3 is contacted thereto.

FIG. 6 illustrates the permanent deformed portion 4*a* (trace of contact resulting from being left with the press-contact state) at (b) and (c).

When the photosensitive member 1 is electrically charged by the charging roller 4 having such a trace of press-contact 4*a*, the fine discharge gap is not uniform, and therefore, periodical image density non-uniformity corresponding to the circumferential length of the charging roller 4 results due to the deformation at the portion of trace of press-contact 4*a* (so-called charging roller trace (C set) ).

In order to prevent the production of the trace of press-contact 4*a* of the charging roller 4 due to the press-contact to the photosensitive member 3, the charging roller 4 and the photosensitive drum 3 are kept spaced apart when they are left unused. More particularly, the use may be made with (1) a clutch for avoiding the press contacting in the initial unused term (simultaneously with rotation of the photosensitive drum in the printer, the charging roller is brought into contact to the photosensitive drum through the clutch mechanism, (2) a spacing member to be inserted to avoid the press contacting in the initial unused term (prior to the insertion of the process cartridge to the main assembly of the printer, the use the removes the spacing member. However, they lead to complication, cost increase and less usability.

Accordingly, it is a principal object of the present invention to provide a charging device gain which even if the charging roller is the formed due to the conduct between the charging roller and the member to be charged, the occurrence of non-uniform charging can be avoided. It is another object of the present invention to provide a charging device in which the non-uniform charging due to the formation of the charging roller is avoided, with the use of low cost and simple voltage source. It is a further object of the present invention to provide a charging device in which a periodical non-uniform charging due to a deformed portion of a charging roller. It is a further object of the present invention to provide a charging device in which density non-uniformity resulting from the charging non-uniformity is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (1) Image Forming Apparatus

Figure 1:
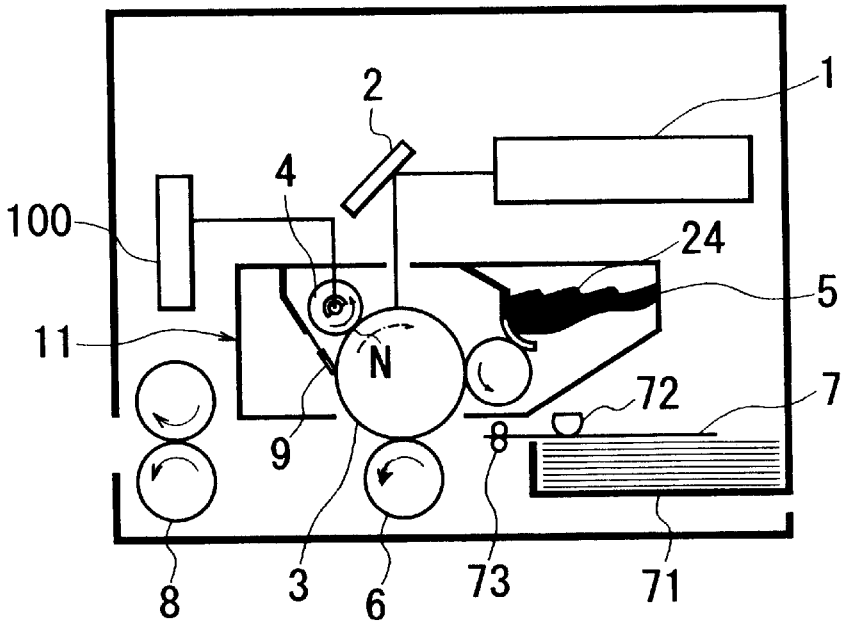
FIG. 1 schematically shows an image forming apparatus according to an embodiment of the present invention.

FIG. 1 is a schematic illustration of the image forming apparatus according to an embodiment of the present invention. In this embodiment, the image forming apparatus is a laser beam printer using a transfer type electrophotographic process, a roller charging type, a DC charging type and a process cartridge mounting-and-demounting type.

Designated by a reference numeral 3 is an electrophotographic photosensitive member (photosensitive drum) in the form of a rotatable drum (electrostatic latent image bearing member). It is rotated in the clockwise direction indicated by an arrow at a predetermined peripheral speed (process speed).

Designated by a reference numeral 4 is a charging roller in the form of an electroconductive elastic roller (contact charging member), which is press-contacted to the photosensitive drum 3 with a predetermined pressure, and is rotated by the rotation of the photosensitive drum 3. The charging roller 4 is supplied with a predetermined DC charging bias from a high voltage source 100 for applying a DC charging bias (voltage applying means), so that outer surface of the rotating photosensitive drum 3 is uniformly charged to a predetermined surface potential.

Designated by 5 is a developing device which functions to develop an electrostatic latent image formed on the surface of the photosensitive drum 5 into a toner image with toner 24 contained in the developing device 5.

On the other hand, the recording material 7 accommodated in the cassette 71 is fed to registration rollers 73 in synchronism with latent image formation on the photosensitive drum 3, by a sheet feeding roller 72. The recording material 7 is fed to a transfer charger 6 including a transfer roller, in synchronism with the leading edge of the latent image formed on the upper, by rotation of the registration rollers 73. The toner image is transferred from the photosensitive drum 5 onto the recording material 7 by the transfer charger 6.

The recording material 7 onto which the toner image has been transferred, is separated from the surface of the photosensitive drum 5, and the toner image is fixed into a permanent image by a fixing device 8. The recording material is finally discharged to the outside of apparatus.

The untransferred toner remaining on the photosensitive drum 3 is removed therefrom by a cleaning device 9 having an elastic blade.

(2) Process Cartridge 11

Figure 2:
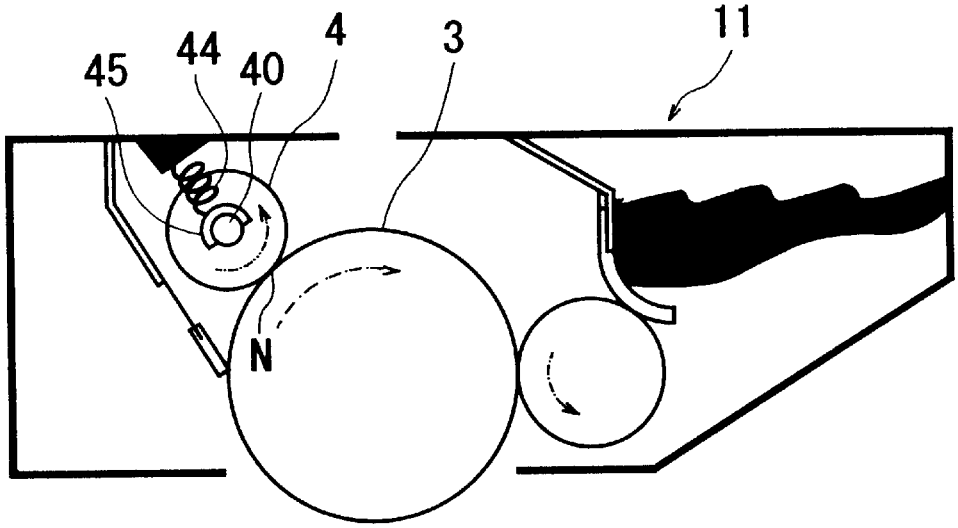
FIG. 2 is an elegant view of a process cartridge portion.

Designated by 11 is a process cartridge which is detachably mountable to a main assembly of the image forming apparatus (the main assembly of the printer). The process cartridge 11 in this embodiment contains as a unit the photosensitive drum 3, the charging roller 4, the developing device 5 and the cleaning device 9 (four process means). FIG. 2 is an enlarged view of the process cartridge 11.

The four process means 3, 4, 5 and 9 are assembled in the cartridge 11 with a predetermined mutual positional relation. The cartridge 11 is mounted into the main assembly of image forming apparatus at a predetermined position in a predetermined manner. Similarly, the process cartridge is removed from the main assembly of apparatus in a predetermined manner.

When the process cartridge 11 is inserted into the main assembly of image forming apparatus at the predetermined portion, the mechanical and electrical connections are established between the process cartridge 11 and the main assembly of image forming apparatus, so that photosensitive drum 3 and the developing roller can be rotated, and the charging roller 4 can be supplied with a charging bias voltage, and the developing roller can be supplied with a developing bias voltage. That is, the image forming operation is enabled.

If the image forming apparatus is used for a long term, the parts such as the photosensitive drum, the charging device, the developing device or the cleaning device are consumed with the result of deterioration of the print quality. Since, however, the image forming apparatus is of a process cartridge mounting-and-demounting type, it will be satisfactory if the process cartridge 11 easy exchanged with a fresh one by the user. In this sense, the maintenance-free image forming apparatus is accomplished.

(3) Charging Roller 4

Figure 3:
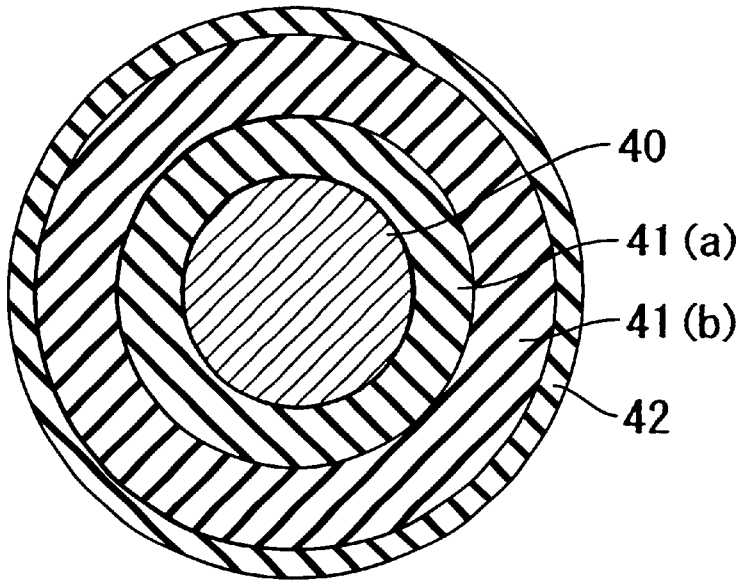
FIG. 3 is a schematic cross-sectional view showing a layer structure of the charging roller.

FIG. 3 is a schematic cross-sectional view illustrating a layer structure of the charging roller 4 used in this embodiment. The charging roller 4 includes a core metal 40 functioning as a rotation shaft and functioning as an electroconductive member for charging bias application from the main assembly of the image forming apparatus, the core metal 40 having an outer diameter of 12 mm, a first electroconductive elastic layer 41(*a*), a second electroconductive elastic layer 41(*b*), and a surface layer 42 (multilayer structure member).

The charging roller 4 is rotatably supported by electroconductive bearing members 45 (FIG. 2) which are slidable toward the photosensitive drum at the opposite ends of the core metal 40 in the inner. The bearing members 45 are urged by pressing springs 44 toward the photosensitive drum with a force of 1.9–9.8N (200-1000 gf) at each end, so that predetermined press-contact nip N are formed between the photosensitive drum 3 and the elastic layer 41. The charging roller 4 is rotated by rotation of the photosensitive member 1.

When the process cartridge 11 is mounted to the main assembly of image forming apparatus in place, a primary high voltage contact (unshown) of the process cartridge 11 is contacted to a primary high voltage contact 46 (FIG. 4) of the main assembly of the image forming apparatus, by which the charging roller 4 can be supplied with a predetermined DC charging bias (primary high voltage) from the high voltage source 100 for the DC charging bias (voltage applying means) in the main assembly, through a contact spring (unshown) contacted to the core metal 40.

(4) Countermeasurement to the Trace of Press-contact

Figure 4:
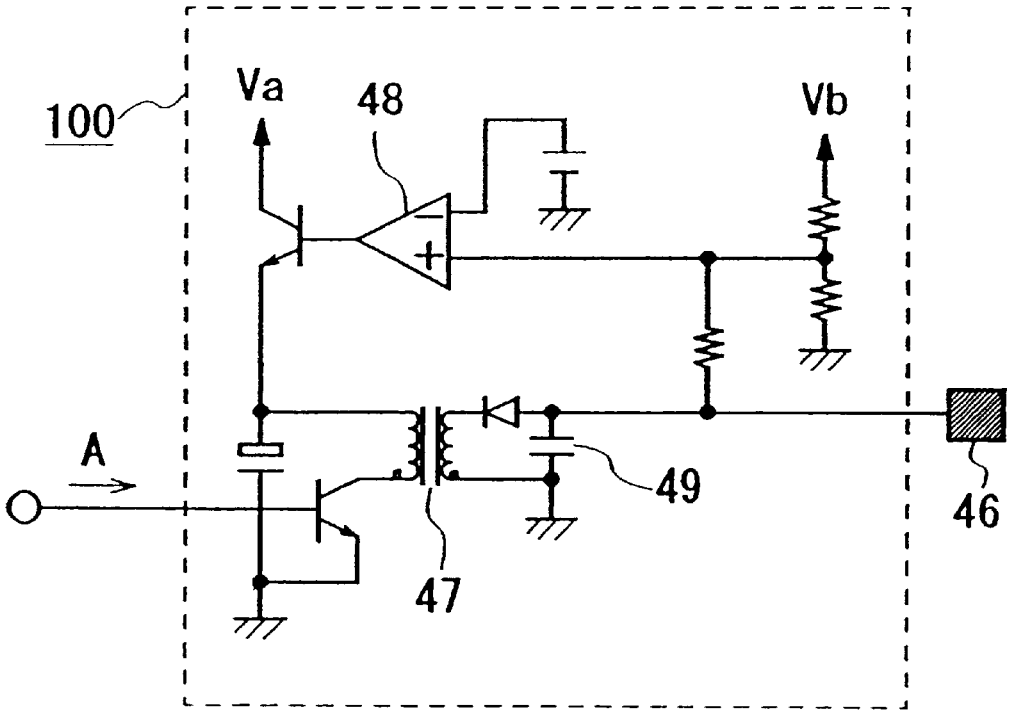
FIG. 4 is a high voltage source circuit diagram for application of DC charging bias voltage.

FIG. 4 is a circuit diagram (primary high voltage circuit) of the high voltage source 100 for DC charging bias application provided in the main assembly of image forming apparatus of this embodiment. In this Figure, high voltage clock signals are supplied in the direction indicated by an arrow A, and the DC charging bias voltage is outputted from the primary high voltage contact 46. Designated by 47 is a high voltage transformer; 48 is a comparator; Va (24 V) and Vb (5 V) are reference potentials; and 49 is a high withstand voltage capacitor in the rectifying circuit. The capacitor 49 is provided electrically in parallel with the high voltage transformer 47 at an output side of the high voltage transformer 47.

Figure 6:
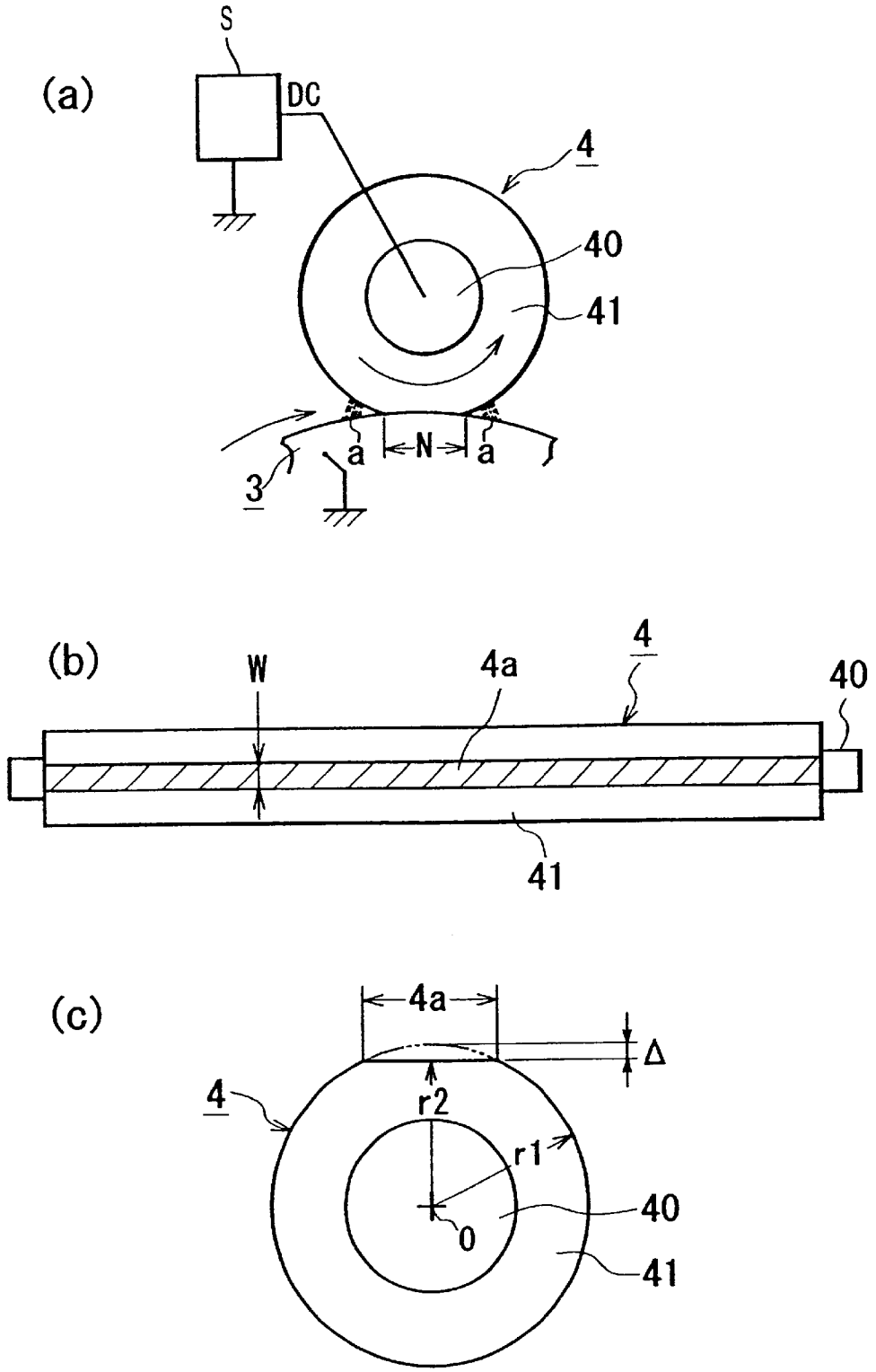
FIG. 6 illustrates a roller charging and a trace of press-contact.

In this embodiment, they use is made with the charging roller 4 having a permanent deformation (trace of press-contact (deformed portion) 4*a*)due to a long term continuous press-contact with the photosensitive drum 3 (for 30 days under 40° C. and 95% RH). As shown in FIGS. 6, (*b*) and (*c*), the trace of press-contact 4*a* has a width w of 0.5–2 mm along the length of the charging roller, and the amount of the deformation δ is 5–100 μm. The deformation δ d& is defined as follows:

δ=(Maximum outer diameter r1 of the roller at the non-contact portion)−(minimum outer diameter r2 of the roller at the contact portion)

Designated by "O" is a center of the core metal 40. The deformation δ has been measured using a laser measuring machine LMG1502LD available from Tokyo Kodenshi Kogyo Kabushiki Kaisha, Japan.

The film thickness of the CT layer (charge transfer layer) of the photosensitive drum 3 is 15 μm, and the process speed is 94.2 mm/s. The applied charging bias was DC-1260 V to electrically charged the photosensitive drum 3. With this voltage, the photosensitive drum charged potential was approx. −740 (V) under the conditions of 23.5° C. and 60% ambience.

Figure 5:
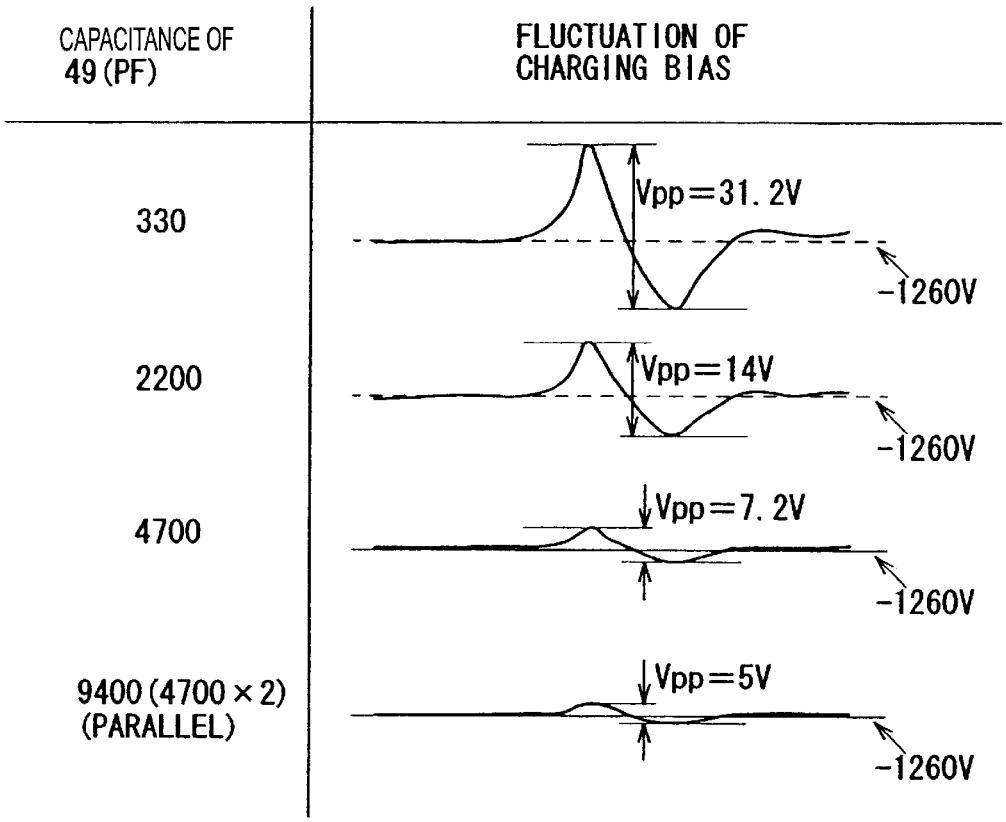
FIG. 5 shows a correlation graph between an electrostatic capacity of a high withstand pressure capacitor and a charging bias waveform.

FIG. 5 shows electrostatic capacities of the high withstand pressure capacitor 49 in the rectifying circuit in the high voltage source circuit 100 for the DC charging bias in FIG. 4 and chose a waveform of charging bias at the time when the trace of press-contact 4*a* on the charging roller passes by the fine discharge region a relative to the photosensitive drum 1. The waveform of the charging bias has been measured at the primary high voltage contact 46 in FIG. 4.

As will be understood from FIG. 5 when the electrostatic capacity of the high withstand pressure capacitor 49 is small, the charging bias significantly varies or wavy fluctuation.

The variation of the charging bias results in instable electric discharge between the charging roller 4 and the photosensitive drum 3, and therefore, uniform charged potential of the photosensitive drum 3 is not expected.

However, if the electrostatic capacity of the high withstand pressure capacitor 49 is increased, the variation of the charging bias is made small. Corresponding to the variation of the charging bias, the C set image level varies. The used image evaluation pattern was a half-tone image (600 dpi, longitudinal lines of 1 dot with 2 spaces.

Table 1 shows electrostatic capacities of the high withstand pressure capacitor 49 and widths of variations of the charging bias (F %), and the levels of C set images.

TABLE 1

| electrostatic capacity of high withstand voltage capacitor 49 (pF) | width of variation of charging bias | ranks of C-set image |
|---|---|---|
| 330 | 2.48 | NG |
| 2200 | 1.11 | Fair |
| 4700 | 0.57 | Good |
| 9400 | 0.4 | Good |

Here, the width of the charging bias variation F % is defined as follows:

The width of charging bias variation F=(maximum value of actual charging bias voltage−minimum value of actual charging bias voltage)×100 /applied charging bias voltage By increasing the electrostatic capacity of the high withstand pressure capacitor 49, the variation of the charging bias resulting from passage of the trace of press-contact 4*a* by the fine discharge regions (charging regions), can be suppressed, so that uniformity of the charging of the photosensitive drum 3 is improved.

In this embodiment, the electrostatic capacity of the high withstand pressure capacitor 49 is not less than 3000 pF, by which the width F of variation of the DC voltage applied to the charging roller 4 when the trace of press-contact 4*a* passes by the discharge regions a between the photosensitive drum 1 and the charging roller 4, has been reduced to less than 1%, so that problem of C set can be solved.

However, when the electrostatic capacity of the high withstand pressure capacitor 49 is simply increased, the rising of the high-voltage becomes dull (because of the larger time constant), and therefore, an image density non-uniformity due to the charged potential difference between the first rotation and the second rotation of the photosensitive drum (a problem of charging power). Table 2 shows electrostatic capacities of the high withstand pressure capacitor 49, C set image levels and charging power.

TABLE 2

| electrostatic capacity of high withstand voltage capacitor 49 (pF) | ranks of C-set image | charging power |
|---|---|---|
| 330 | NG | Good |
| 2200 | Fair | Good |
| 4700 | Good | Good |
| 9400 | Good | Good |
| 14100 | Good | Fair |

By making the electrostatic capacity of the high withstand pressure capacitor 49 not more than 10000 pF, image defect attributable to the charging power can be solved.

Thus, by the electrostatic capacity of the high withstand pressure capacitor 49 in the rectifying circuit of the high voltage source circuit (primary high voltage circuit) for the DC charging bias shown in FIG. 4 (voltage applying means for the charging roller 4), which is not less than 3000 pF and not more than 10000 pF, the width F of variation of the DC voltage applied to the charging roller 4 when the trace of press-contact 4*a* formed on the surface of the charging roller 4 passes by the discharge regions a between the photosensitive drum 1 and the charging roller 4 is suppressed to not more than 1%, so that periodical density non-uniformity resulting from permanent deformation of the charging roller 4 due to long term unuse with the pressure conduct kept, can be suppressed, and in addition, the image density non-uniformity attributable to the charged potential difference between the first rotation and the second rotation of the photosensitive drum 1, can be suppressed.

Thus, according to this embodiment, the capacitor capacity of the high voltage source circuit for the DC charging bias voltage (voltage applying means for the charging roller 4) is made optimum so that width F of the variation of the waveform of the applied charging bias to the charging roller 4 when the trace of press-contact 4*a* of the charging roller 4 passes by the discharge regions an is made not more than 1%. By doing so, even if the charging roller 4 involves a trace of press-contact 4*a*, the photosensitive drum 3 can be uniformly charged, and therefore, C set can be avoided. This eliminates additional means such as means for avoiding continuous long term press-contact state. Therefore, simple and low cost means for avoiding the problem can be provided.

(5) Other Embodiments

1) In the foregoing embodiment, the charging roller 4 is driven by the photosensitive drum 3. However, the present invention is applicable to the case in which the charging roller 4 is driven with peripheral speed difference from the photosensitive drum 3, for example.

2) In the foregoing embodiment, the charging roller 4 has a 3 layer structure 41(*a*), 41(*b*) and 42. This is not limiting, and the charging roller has another structure and/or material.

3) The charging device of the present invention may be used for electrically charging various members or materials other than the electrostatic latent image bearing member for the image forming apparatus.

4) The process cartridge is a cartridge which contains as a unit the developing means, the charging means and the electrophotographic photosensitive member and which is detachably mountable to the image forming apparatus. The process cartridge may include the charging means and the electrophotographic photosensitive member, and is detachably mountable to the main assembly of the image forming apparatus.

5) In the foregoing embodiment, the image forming apparatus is a laser beam printer, but the present invention is applicable to other image forming apparatus such as a copying machine, a facsimile machine, a word processor or the like using an electrophotographic process or an electrostatic recording process.

As described in the foregoing, in a contact charging device of a roller charging type or a DC charging type, and in an image forming apparatus or the like using such a charging device, even when a permanent deformation occurs in the elastic roller 4 due to continuous long-term press-contact between the elastic roller and the member to be charged, the charging non-uniformity occurring at the rotation period of the elastic roller and/or the problem of C set in the case of the image forming apparatus and the process cartridge due to the same causes, can be avoided.

While the invention has been described with reference to the structures disclosed herein, it is not confined to the details set forth and this application is intended to cover such modifications or changes as may come within the purpose of the improvements or the scope of the following claims.

What is claimed is:

1. A charging device comprising:

a rotatable elastic charging roller, contactable to a member to be charged, and configured and positioned to electrically charge the member to be charged; and DC voltage applying means for applying a DC voltage to said charging roller, wherein said voltage applying means is capable of controlling the width of a variation of the DC voltage to be not more than 1%, the variation being caused by passage of a deformed portion of said charging roller resulting from contact between the member to be charged and said charging roller by a charging region of said charging roller for the member, and wherein the width of the variation is [(a maximum value of actual charging voltage)−(a minimum value of actual charging voltage)]×100/(applied charging voltage).

2. A charging device according to claim 1, wherein said deformed portion is provided by the member to be charged and said charging roller being kept in contact for 30 days under a temperature of 40° C. and a relative humidity of 95%.

3. A charging device according to claim 1, wherein said voltage applying means includes a voltage source which includes a rectifying circuit, which, in turn, includes a capacitor.

4. A charging device according to claim 3, wherein said capacitor has a capacitance of not less than 3000 pF.

5. A charging device according to claim 4, wherein said capacitor has a capacitance of not more than 10000 pF.

6. A charging device according to claim 1, wherein said voltage applying means includes a voltage source which has a capacitor connected electrically in parallel with a high voltage transformer, at an output side of the high voltage transformer.

7. A charging device according to claim 6, wherein said capacitor has a capacitance of not less than 3000 pF.

8. A charging device according to claim 7, wherein said capacitor has a capacitance of not more than 10000 pF.

9. A charging device according to claim 1, wherein the member to be charged is an image bearing member on which an electrostatic image is formed using electric charging by said charging roller.

10. A charging device according to claim 9, wherein the image bearing member and said charging roller are provided in a process cartridge detachably mountable to a main assembly of an image forming apparatus.

11. A charging device comprising:

a rotatable elastic charging roller, contactable to a member to be charged, and configured and positioned to electrically charge the member to be charged; and a DC voltage source configured and positioned to apply a DC voltage to said charging roller, wherein said voltage source includes a capacitor connected electrically in parallel with a high voltage transformer at an output side of the high voltage transformer, and said capacitor has a capacitance of not less than 3000 pF and not more than 10000 pF.

12. A charging device according to claim 11, wherein the member to be charged is an image bearing member on which an electrostatic image is formed using electric charging by said charging roller.

13. A charging device according to claim 12, wherein the image bearing member and said charging roller are provided in a process cartridge detachably mountable to a main assembly of an image forming apparatus.

* * * * *

UNITED STATES PATENT AND TRADEMARK OFFICE

CERTIFICATE OF CORRECTION

PATENT NO. : 6,690,897 B2
DATED : February 10, 2004
INVENTOR(S) : Norio Takami

It is certified that error appears in the above-identified patent and that said Letters Patent is hereby corrected as shown below:

Column 1,
Line 63, “and” should read -- end --.

Column 4,
Line 31, “easy” should read -- is easily --.
Line 51, “are” should read -- is --.

Column 5,
Line 14, “they” should be deleted and “with” should read -- of --.
Line 50, “FIG. 5” should read -- FIG. 5, --.

Column 7,
Line 2, “unuse” should read -- lack of use --.

Signed and Sealed this

Thirteenth Day of July, 2004

JON W. DUDAS
*Acting Director of the United States Patent and Trademark Office*